US005903808A

United States Patent [19]

Takizawa et al.

[11] Patent Number: 5,903,808

[45] Date of Patent: May 11, 1999

[54] DEVELOPING ROLLER AND DEVELOPING APPARATUS

[75] Inventors: Yoshio Takizawa, Fussa; Koji Takagi, Kawasaki; Takahiro Kawagoe, Tokorozawa, all of Japan

[73] Assignee: Bridgestone Corporation, Tokyo, Japan

[21] Appl. No.: 08/714,323

[22] Filed: Sep. 18, 1996

[30] Foreign Application Priority Data

Oct. 2, 1995 [JP] Japan ..... 7-278386
Oct. 20, 1995 [JP] Japan ..... 7-297572

[51] Int. Cl.[6] ..... G03G 13/16; G03G 15/08

[52] U.S. Cl. ..... 399/286; 492/18; 492/56

[58] Field of Search ..... 492/18, 25, 48, 492/56, 59; 399/286, 279, 265; 430/120

[56] References Cited

U.S. PATENT DOCUMENTS 5,099,285 3/1992 Hirano et al. ..... 399/286
5,697,027 12/1997 Takagi et al. ..... 399/279
5,741,616 4/1998 Hirano et al. ..... 399/286 X

*Primary Examiner*—Arthur T. Grimley
*Assistant Examiner*—Sophia S. Chen
*Attorney, Agent, or Firm*—Sughrue, Mion, Zinn, Macpeak & Seas, PLLC

[57] ABSTRACT

A developing roller is adapted to carry a developer on its surface and come in contact with or close to a photoconductor drum having an electrostatic latent image borne on its surface whereby the developer is supplied to the drum to visualize the latent image. The developing roller includes a highly conductive shaft and an elastic layer with conductivity formed around the shaft. The elastic layer is surface treated so as to have a resin component which contains a urea resin and/or melamine resin. The roller satisfies log $(R_2/R_1) \leqq 4.5$ wherein the untreated roller has a resistance $R_1$ and the roller with the resin component has a resistance $R_2$. The developing roller does not contaminate the photoconductor drum and ensures that images of quality are reproduced without a density variation and background fog over a long time.

18 Claims, 2 Drawing Sheets

DEVELOPING ROLLER AND DEVELOPING APPARATUS

BACKGROUND OF THE INVENTION

1. Field of the Invention

This invention relates to a developing roller and apparatus for use in electrophotographic and electrostatic recording machines such as copiers and printers for developing an electrostatic latent image with a developer such as a one-component developer for visualization. More particularly, it relates to a developing roller and apparatus which is improved in anti-staining so that acceptable images can be produced in a stable manner over a long term.

2. Prior Art

In conjunction with prior art electrophotographic and electrostatic recording machines such as copiers and printers, one typical developing method is an impression developing method as disclosed in U.S. Pat. Nos. 3,152,012 and 3,731,146. This developing method visualizes electrostatic latent images by supplying a non-magnetic one-component developer to a photoconductor drum bearing a latent image, thereby adhering the developer to the latent image. Since the impression developing method eliminates a need for magnetic material, the apparatus can be simple and compact and color toner can be used.

More particularly, the impression developing method is by bringing a developing roller carrying a toner or non-magnetic one-component developer in contact with a latent image holder or photoconductor drum bearing an electrostatic latent image, thereby adhering the toner to the latent image. The developing roller must be formed of an elastic material having electrical conductivity.

Referring to FIG. 2, the impression developing method is briefly described. A developing roller 1 having a conductive elastomer layer is placed between a toner feed roller 4 for feeding a toner 6 and a photoconductor drum 5 having an electrostatic latent image borne thereon. Upon rotation of the developing roller 1, photoconductor drum 5, and toner feed roller 4 in the directions shown by arrows, the toner 6 is fed from the feed roller 5 onto the surface of the developing roller 1 and 15 regulated into a uniform thin layer by a doctor blade 7. The thin layer of toner is then delivered from the developing roller 1 to the photoconductor drum 5 to adhere to the latent image whereby the latent image is developed into a visible toner image. The toner image is finally transferred from the photoconductor drum 5 to a record medium, typically paper in a transfer section 8. Also included is a cleaning section 9 having a cleaning blade 10 for scraping off the toner left on the photoconductor drum 5 after the transfer step.

During rotation, the developing roller 1 must maintain close contact with the photoconductor drum 5. The conventional developing roller 1 is of a structure having a conductive elastic layer 3 around a shaft 2 as shown in FIG. 1. The shaft 2 is of a highly conductive material, typically metal. The conductive elastic layer 3 is formed of a conductive elastomer in the form of an elastic rubber such as silicone rubber, acrylonitrile-butadiene rubber (NBR), and ethylene-propylene-diene terpolymer (EPDM) or a sponge such as urethane foam, with a suitable conductive agent being blended therein.

However, the prior art developing rollers had the following problems resulting from the properties of elastic layers used therein.

(1) Where the developing roller is formed of an elastic rubber such as silicone rubber, NBR and EPDM having a low hardness enough to achieve tight contact, the photoconductor drum can be contaminated therewith.

(2) Where a spongy body such as urethane foam is used to form the elastic layer, toner can penetrate into pores in the elastic layer. As the penetrating toner accumulates on long-term use, the roller becomes harder and electrical charging of toner becomes inefficient, resulting in a drop of image quality. This tendency is also found when the roller has a surface receptive to toner deposits.

(3) Where the developing roller has a single elastic layer, it creates a greater burden between the developing blade and the photoconductor because of a very large coefficient of friction on its surface. This leads to uneven toner transfer and driving jitter, both resulting in defective images. Also in the developing roller with a single elastic layer, charging of toner on the roller does not show a quick rise and the roller surface is readily contaminated with toner. This often invites fogging due to poor charging of toner and a loss of print density. A substantial drop of print quality occurs after long-term continuous printing.

Therefore, an object of the present invention is to provide a developing roller which has a relatively low hardness enough to ensure tight contact and does not contaminate the photoconductor drum so that images of quality free of density variation and background fog can be consistently produced over a long term without a drop of quality. Another object of the present invention is to provide a developing apparatus using such a developing roller.

SUMMARY OF THE INVENTION

Regarding a developing roller comprising a highly conductive shaft and an elastic layer with conductivity formed around the shaft, the inventors have found that when a resin component which contains a urea resin and/or melamine resin is applied to the surface of the elastic layer such that the roller may satisfy the relationship:

$$\log(R_2/R_1) \leqq 4.5$$

wherein, the roller free of the resin component has a resistance $R_1$ and the roller with the resin component has a resistance $R_2$, there is obtained a developing roller which is effective for preventing the photoconductor from being contaminated, low in friction, and stable in toner charging.

More particularly, the inventors have found that while contamination of the photoconductor is likely to occur in the absence of developer between the developing roller and the photoconductor, that is, at an initial stage prior to use, application of the resin component to the developing roller surface is effective for preventing such contamination; that surface treatment of the developing roller with a urea or melamine resin is effective for reducing friction, thereby improving the drivability and toner transfer of the roller; and that the charge quantity the developer on the roller surface acquires can be optimized by properly adjusting the resistances $R_1$ and $R_2$ of the roller before and after application of the resin component. As a consequence, images of quality free of density variation and background fog can be consistently produced and no drop of image quality occurs over a long term.

In a first aspect, the present invention provides a developing roller adapted to carry a developer on its surface to form a thin layer of the developer and come in contact with or close to a latent image holder having an electrostatic latent image borne on its surface whereby the developer is supplied to the latent image holder to visualize the latent image. In a second aspect, the present invention provides an apparatus for developing an electrostatic latent image comprising a latent image holder for bearing an electrostatic latent image on its surface and a developing roller for carrying a developer on its surface wherein the developing roller is brought in contact with or close to the surface of the latent image holder whereby the developer is adhered to the latent image on the surface of the latent image holder to visualize the latent image. In the first and second aspects of the invention, the developing roller comprises a highly conductive shaft and an elastic layer with conductivity formed around the shaft. The elastic layer at its surface has a resin component which contains at least one of a urea resin and melamine resin. The roller satisfies the relationship:

$\log(R_2/R_1) \leqq 4.5$ wherein the roller free of the resin component has a resistance $R_1$ and the roller with the resin component has a resistance $R_2$.

Continuing research work, the inventors have found that the developing roller of the invention is more effective for charging the toner when the resin component at the surface of the elastic layer is free of conductive powder such as carbon black. When the developing roller is used in printers requiring high speed operation, not only anti-staining and toner charging are required, but also fog occurring when the potential difference between the photoconductor and the developing roller is small, known as low-voltage fog, must be prohibited. In this regard, as opposed to the first-mentioned case, the occurrence of low-voltage fog can be effectively minimized by incorporating conductive powder such as carbon black in the resin component.

In one embodiment of the developing roller according to the invention, the resin component is free of conductive powder. In another embodiment of the developing roller, the resin component is blended with conductive powder.

BRIEF DESCRIPTION OF THE DRAWINGS

These and further features of the present invention will be apparent with reference to the following description and drawings, wherein.

DESCRIPTION OF THE PREFERRED EMBODIMENTS

Figure 1:
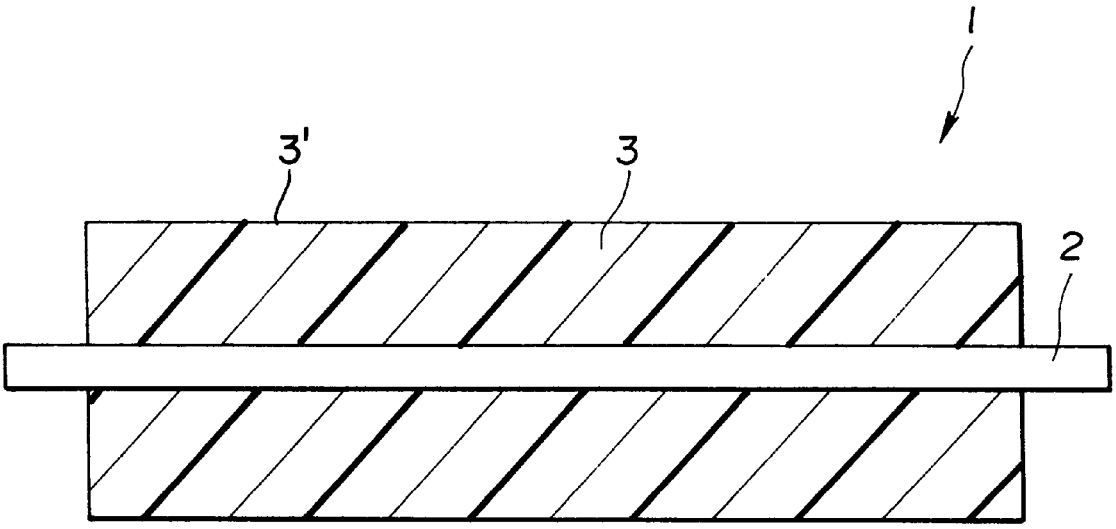
FIG. 1 is a schematic cross-sectional view of a developing roller according to the invention.

Referring to FIG. 1, there is illustrated a developing roller according to the invention. The developing roller 1 includes a highly conductive shaft 2 and a cylindrical elastic layer 3 formed around the shaft 2 and having conductivity. According to the invention, the elastic layer 3 at its surface has a resin component 3' which contains a urea resin and/or melamine resin such that the roller may satisfy the relationship:

$\log(R_2/R_1) \leqq 4.5$ wherein the roller free of the resin component has a resistance $R_1$ and the roller with the resin component 3' has a resistance $R_2$.

Any desired shaft may be used insofar as it is a good conductor. The shaft is typically selected from metallic shafts, for example, solid metal cores and hollow metal cylinders.

The elastic layer 3 around the shaft 2 is generally formed of a composition comprising an elastomer (typically polyurethane and EPDM) or foam and a conductive agent. Examples of the conductive agent include conductive powders such as carbon black, metals and metal oxides and ionic conductive substances such as sodium perchlorate although the conductive agent will be described later in more detail. The conductive agent is blended such that the composition (elastic layer) may have a resistance in the medium range of $10^3$ to $10^{10}$ Ωcm, especially $10^4$ to $10^8$ Ωcm.

The base of the elastic layer composition is generally selected from polyurethane, natural rubber, butyl rubber, nitrile rubber, polyisoprene rubber, polybutadiene rubber, silicone rubber, styrene-butadiene rubber, ethylene-propylene rubber, ethylene-propylene-diene terpolymer (EPDM), chloroprene rubber, acryl rubber, and mixtures thereof. Polyurethane and EPDM are preferred.

Polyurethane is first described. There may be used any of polyurethane elastomers and foams which are conventionally prepared. For example, they may be prepared by blending carbon black in polyurethane prepolymer and subjecting the prepolymer to crosslinking reaction. Another known method is by blending a conductive material in a polyhydroxyl compound and reacting it with a polyisocyanate by a one-shot technique. The polyurethane is generally prepared from a polyhydroxyl compound and a polyisocyanate compound. As the polyhydroxyl compound, use may be made of polyols commonly used in the preparation of flexible polyurethane foams and urethane elastomers, such as polyether polyols and polyester polyols terminated with a polyhydroxyl group, and polyester polyether polyols obtained by copolymerizing the former two; and other conventional polyols, for example, polyolefin polyols such as polybutadiene polyols and polyisoprene polyols, and polymer polyols obtained by polymerizing ethylenically unsaturated monomers in polyols. Examples of the polyisocyanate compound include polyisocyanates commonly used in the preparation of flexible polyurethane foams and urethane elastomers, such as tolylene diisocyanate (TDI), crude TDI, diphenylmethane-4,4'-diisocyanate (MDI), crude MDI, aliphatic polyisocyanates having 2 to 18 carbon atoms, alicyclic polyisocyanates having 4 to 15 carbon atoms, and mixtures and modified products of these polyisocyanates, e.g., prepolymers partially reacted with polyols.

EPDM is a terpolymer of ethylene, propylene, and a third component. The third component is not critical although it is preferably selected from dicyclopentadiene, ethylidene norbornene, and 1,4-hexadiene. The proportion of ethylene, propylene, and the third component is not critical although it is preferred that the content of ethylene is 5 to 95% by weight, the content of propylene is 5 to 95% by weight, and the content of third component corresponds to an iodine value of 0 to 30. A mixture of two or more EPDM having different iodine values is also acceptable. Also EPDM may be blended with silicone rubber and/or silicone-modified EPDM. Better results are obtained when 100 parts by weight of EPDM is blended with 5 to 80 parts by weight of silicone rubber and/or silicone-modified EPDM. It is noted that the silicone-modified EPDM is a hybrid rubber wherein the bonding force between EPDM and silicone polymers is enhanced by a silanol compound or siloxane.

Crosslinking agents and vulcanizing agents may be added to the elastic layer composition in order to crosslink the base resin into a rubbery material of which the elastic layer is made. In either of organic peroxide crosslinking and sulfur crosslinking systems, crosslinking aids, vulcanization accelerators, vulcanization co-accelerators, and vulcanization retarders may be used. Additionally, there may be blended other additives commonly used in rubber, for example, peptizers, blowing agents, plasticizers, softeners, tackifiers, anti-tack agents, separating agents, mold release agents, extenders, and coloring agents.

To the elastic layer composition based on polyurethane or EPDM, there may be added various charge control agents such as Nigrosine, triaminophenylmethane, and cationic dyes for the purpose of controlling the charge quantity of toner on the surface of the developing roller as well as microparticulate fillers such as silicone resin, silicone rubber, and nylon. Better results are obtained when 100 parts by weight of polyurethane or EPDM is blended with 1 to 5 parts by weight of the charge control agent and 1 to 10 parts by weight of the microparticulate filler.

As previously mentioned, conductive agents including conductive powders and ionic conductive substances are blended in the elastic layer composition for imparting appropriate conductivity thereto. Examples of the conductive powder include conductive carbon such as Ketjen Black EC and acetylene black; carbon for rubber such as SAF, ISAF, HAF, FEF, GPF, SRF, FT, and MT; oxidized carbon for color ink; pyrolytic carbon; natural graphite, synthetic graphite; metals and metal oxides such as antimony-doped tin oxide, titanium oxide, zinc oxide, nickel, copper, silver and germanium; and conductive polymers such as polyaniline, polypyrrole, and polyacetylene. Among others, carbon black is preferred since it is inexpensive and easy to control conductivity with small amounts. Preferably about 0.5 to 50 parts, more preferably about 1 to 30 parts by weight of the conductive powder is blended with 100 parts by weight of the polyurethane or EPDM.

Examples of the ionic conductive substance include inorganic ionic conductive substances such as sodium perchlorate, lithium perchlorate, calcium perchlorate, and lithium chloride and organic ionic conductive substances such as modified aliphatic dimethylammonium ethosulfates, stearylammonium acetate, laurylammonium acetate, octadecyl-trimethylammonium perchlorate, and tetrabutylammonium borofluoride.

The conductive agent is preferably blended such that the composition (elastic layer) may have a resistance in the medium range of $10^3$ to $10^{10}$ Ωcm, especially $10^4$ to $10^8$ Ωcm. With a resistance of less than $10^{10}$ Ωcm, electric charges can leak to the photoconductor drum and the developing roller itself can be broken by the applied voltage. With a resistance of more than $10^{10}$ Ωcm, background fogging would often occur in the resultant image.

Preferably the elastic layer 3 is given a hardness of up to 60°, especially 25° to 55° on JIS A scale. With a hardness of more than 60°, the contact area with the photoconductor drum would be reduced, failing to carry out satisfactory development. Too low hardness would invite an excessive compression set, which would cause a density variation in the toner image when the developing roller is deformed or radially misaligned for some reason or other. Then when the elastic layer is to be adjusted to a low hardness, it is preferred to minimize the compression set, typically to 20% or less.

The developing roller of the invention preferably has a surface roughness Rz of up to 15 μm, more preferably 1 to 10 μm as measured on JIS ten point mean roughness scale. A developing roller with a surface roughness of more than 15 μm would adversely affect the thickness and uniform charging of a layer of one-component developer or toner formed thereon. A surface roughness of up to 15 μm is effective for achieving appropriate adhesion of toner to the developing roller and preventing the toner image from being deteriorated as the roller is worn during long-term use.

In the developing roller according to the invention, the elastic layer at its surface has a resin component which contains a urea resin and/or a melamine resin. The roller satisfies the relationship:

$\log(R_2/R_1) \leqq 4.5$, preferably $\log(R_2/R_1) \leqq 3$ wherein the roller free of the resin component has a resistance $R_1$ and the roller with the resin component 3' has a resistance $R_2$.

The resin component used herein is not critical insofar as it contains a urea resin and/or a melamine resin which is sometimes referred to as an essential constituent. The resin component may consist solely of the essential constituent, or the essential constituent may be crosslinked with another resin constituent, or the essential constituent may be mixed with another resin constituent. Use of the essential constituent crosslinked with another resin constituent is especially preferred because the roller becomes more durable when actually used in printers. Examples of the urea resin used as a starting raw material include dimethylolurea, dialkoxymethyl urea cyclic trimer, alkoxylmethyl urea cyclic trimer, etc. Examples of the melamine resin include trimethylol melamine and hexamethoxy-methyl melamine. These essential constituents may be used alone or in admixture of two or more.

The other resin constituent to be blended in the resin component is not critical insofar as it is non-contaminative to the latent image holder or photoconductor drum. Preferred are resins having a hydroxyl group. Examples include alkyd resins, modified alkyd resins such as phenol- or silicone-modified alkyd resins, oil-free alkyd resins, acrylic resins, silicone resins, fluorocarbon resins, phenolic resins, polyamide resins, epoxy resins, polyester resins, maleic resins, and urethane resins. Among these, modified alkyd resins, oil-free alkyd resins, and acrylic resins are preferred from the standpoints of film formation and adhesion.

In the practice of the invention, the essential resin constituent (urea or melamine resin) and the other resin constituent are usually mixed in a weight ratio between 100/1 and 1/100, preferably between 50/50 and 10/90. If the weight ratio of the essential resin constituent to the other resin constituent is beyond the range, a surface of the developing roller would sometimes become brittle and less durable when actually used in printers. If this weight ratio is below the range, toner charging would become poor and toner filming resistance would deteriorate.

If necessary, the resin component may be blended with a conductive substance which is the same as previously mentioned for the elastic layer itself. In most cases, however, it is preferred to omit conductive powder such as carbon black. Use of a resin component free of conductive powder leads to better toner charging.

Nevertheless, conductive powder such as carbon black may be blended when not only anti-staining and toner charging, but also prevention of low-voltage fog are required on the use of the developing roller in printers requiring high speed operation. Then the occurrence of low-voltage fog is effectively prohibited. In this embodiment, the resistances $R_1$ and $R_2$ of the roller before and after application of the resin component are adjusted so as to satisfy the relationship: preferably $\log(R_2/R_1) \leqq 3.5$, especially $\log(R_2/R_1) \leqq 2.5$. If $\log(R_2/R_1) > 3.5$, the objects of the invention including minimized contamination and effective toner charging would not be attained. The conductive powder, if blended, is used in an amount of 0.1 to 50 parts by weight, especially 1 to 20 parts by weight per 100 parts by weight of the resin component. When the ionic conductive substance is used as the conductive agent, it is used in an amount of 0.001 to 1 part by weight per 100 parts by weight of the resin component.

Means for applying the resin component to the surface of the elastic layer is not critical although it is preferred to treat the elastic layer on its surface with a solution containing the resin component in a solvent. The solvent used herein is not critical insofar as the resin component is soluble therein. Preferred solvents are lower alcohols such as methanol, ethanol, and isopropanol, ketones such as acetone, methyl ethyl ketone (MEK), and cyclohexanone, aromatic solvents such as toluene and xylene. The concentration of the resin component in the resin solution is not critical insofar as the roller treated therewith satisfies the relationship: $\log(R_2/R_1) \leqq 4.5$ and preferably $\log(R_2/R_1) \leqq 3.5$ when conductive powder is additionally blended. Often the solution contains the resin component in a concentration of up to 15% by weight, especially up to 10% by weight.

After preparation of the treating solution, surface treatment may be done by spraying, roll coating and dipping methods. In the case of surface treatment by dipping, for example, a roller having an elastic layer formed thereon is dipped in the resin solution having a desirable resin concentration, typically at room temperature for 5 seconds to 5 minutes, preferably 10 seconds to 1 minute, pulling up the roller, and drying. Where spraying is employed, the resin solution may have a higher resin concentration than used in dipping, for example, 10 to 30% by weight. The objects of the invention are achievable by any desired application method insofar as the resin component can be imparted to the surface of the elastic layer so as to meet $\log(R_2/R_1) \leqq 4.5$ and preferably $\log(R_2/R_1) \leqq 3.5$ when conductive powder is additionally blended.

The above-mentioned surface treatment with the resin component is effective for reducing the friction of the roller surface to a certain extent although various additives may be added to the resin component for the purpose of further reduction of friction. Examples of the additive which does not contaminate the photoconductor or deteriorate the uniformity of surface treatment with the resin component and which can reduce friction include silicone resins, silicone resin powder, fluorocarbon resins, fluorinated and silicone surfactants, silicon coupling agents, and silica powder. The silicone resins used herein are those soluble in solvents, for example, methyl silicone, methylphenyl silicone, modified products thereof, and silicone-epoxy block copolymers. The silicone resin powder used herein may be microparticulate powders of methyl silicone polymers, methylphenyl silicone polymers, and amino-modified silicone polymers, of spherical or irregular shape having a mean particle size of 0.1 to 100 $\mu$m. The fluorocarbon resins include polytetrafluoroethylene, polyvinylidene fluoride, fluorinated ethylene propylene, and tetrafluoroethylene-perfluoroalkyl vinyl ether copolymers. The fluorinated surfactants include ionic surfactants in the form of alkyl fluorides bonded with carboxylic acids, carboxylates or sulfonates, non-ionic surfactants in the form of alkyl fluorides bonded with alcohols or ethers, and polymeric surfactants in the form of polymers and copolymers containing alkyl fluoride in their backbone. The silicone surfactants include polymers of methyl silicone such as siloxaneoxyethylene bonded with hydrophilic or lipophilic segments and copolymers of methylsilicone with acrylic segments. The silicon coupling agents include conventional silane coupling agents and silanes having an amino, isocyanate or vinyl group introduced at a terminal. These additives may be used alone or in admixture of two or more. The friction reducing agent is preferably used in an amount of 1 to 100 parts, especially 10 to 75 parts by weight per 100 parts by weight of the resin component.

Figure 3:
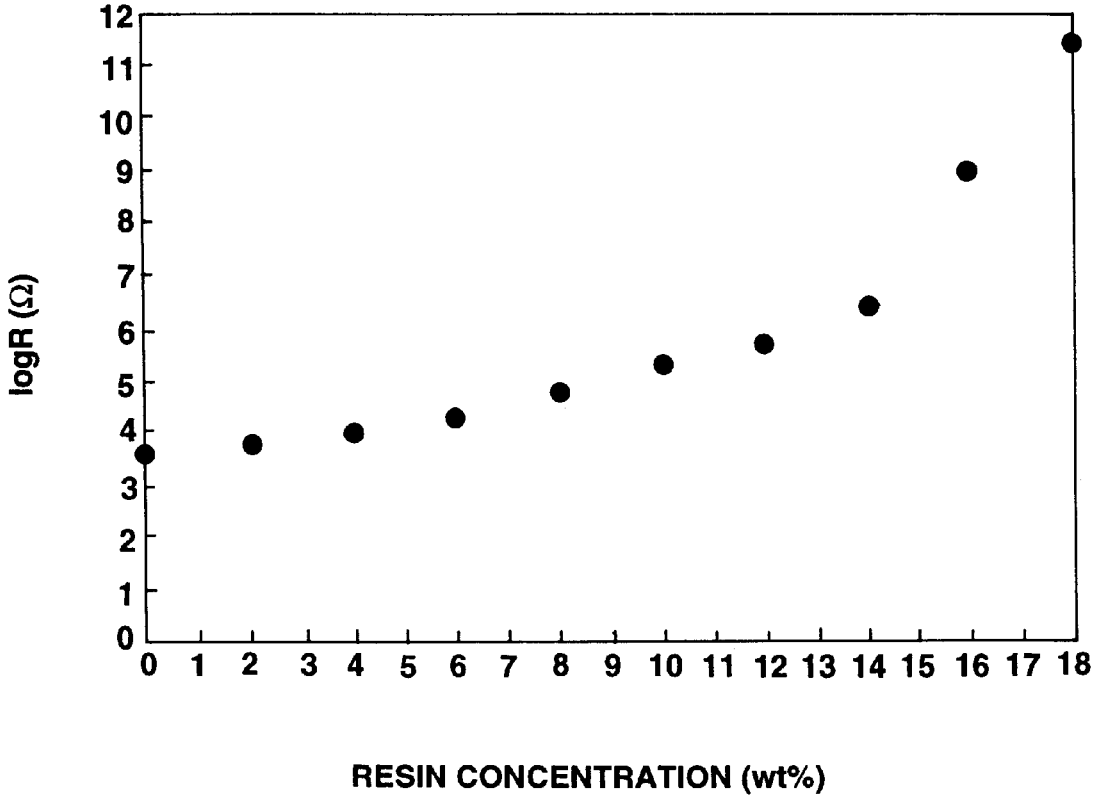
FIG. 3 is a graph showing the resistance of a roller versus a resin concentration of a solution for use in the surface treatment of the roller.

It is understood that the resin component non-uniformly adheres to the surface of the elastic layer 3 in most cases although it can be uniformly adhered to the elastic layer. The non-uniform adherence of the resin component to the elastic layer is desirable for achieving the objects of the invention. More particularly, after the developing roller is surface treated with the resin component, a uniform coating layer of the resin component is not formed, and instead, the elastic layer is locally exposed outside. In particular, ground streaks on the elastic layer protrude outward. This surface state is readily judged by visually observing the treated roller surface under a scanning electronmicroscope (SEM). If a uniform coating were formed on the elastic layer, measurement of roller resistance should show that the roller resistance rapidly increases in substantial proportion to the concentration of the treating resin component. However, the roller treated with a resin solution having an appropriate concentration according to the invention does not show such a tendency. For example, when a roller was treated with a melamine resin-crosslinked alkyd resin solution, the roller resistance (logR) moderately increased in a concentration range of from 0% to 10 or 15% by weight and rapidly increased thereafter as shown in the graph of FIG. 3.

As opposed to the ordinary situation wherein a smooth surface is treated with a resin solution to form a uniform coating layer of several microns thick, the surface treatment of the invention ensures that the resin component is non-uniformly adhered to the surface of the elastic layer, thereby improving surface characteristics while maintaining the rough topography of the elastic layer.

Figure 2:
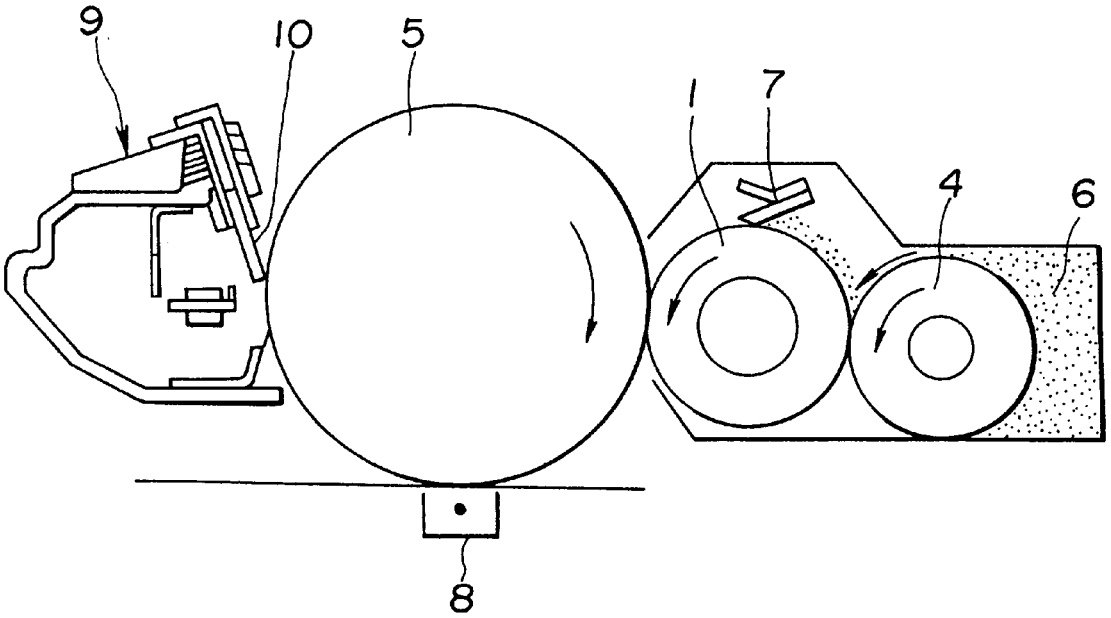
FIG. 2 schematically illustrates an electrophotographic system to which the present invention is applicable.

The developing roller of the invention can be mounted in conventional developing apparatus adapted to use a one-component developer. For example, as shown in FIG. 2, the developing roller 1 is disposed between the toner applicator roller 4 for feeding toner and the photoconductor drum 5 bearing an electrostatic latent image thereon, with the developing roller 1 set in contact with or in close proximity to the photoconductor drum 5. Toner 6 is supplied from the toner applicator roller 4 to the developing roller 1 and regulated into a uniform thin layer by the regulating blade 7. The toner is then supplied from its thin layer on the developing roller to the photoconductor drum 5, thereby adhering the toner to the electrostatic latent image on the drum 5 for visualization. The detail of the arrangement shown in FIG. 2 is omitted since it has been described in the preamble.

The one-component developer used herein is preferably a non-magnetic one-component developer although a magnetic one-component developer is useful. The developing roller and apparatus of the invention can be advantageously used when black-and-white images are printed using a magnetic one-component developer, for example.

EXAMPLE

Examples of the present invention are given below by way of illustration and not by way of limitation. Surface treatment was done by dipping in a treating solution at room temperature for 30 seconds. All parts are by weight.

Example 1

A polyol composition was prepared by premixing 100 parts of a polyether polyol obtained by adding propylene oxide and ethylene oxide to glycerin so as to give a molecular weight of 5,000 and an OH value of 33 with 1.0 part of 1,4-butane diol, 1.5 parts of a silicone surfactant, 0.5 part of nickel acetylacetonate, 0.01 part of dibutyltin dilaurate, and 2.0 parts of acetylene black in a mixer, and milling the mixture in a paint roll mill for uniformly dispersing acetylene black.

A developing roller of the structure shown in FIG. 1 was prepared by agitating the polyol composition in vacuum for deaeration, adding 17.5 parts of urethane-modified MDI thereto, agitating the mixture for 2 minutes, casting the mixture into a mold at 110° C. with a metallic shaft set therein, curing the mixture for 2 hours, thereby forming an elastic layer around the shaft. The developing roll on the surface was ground to a surface roughness Rz of 7 $\mu$m on JIS ten point mean roughness scale.

The developing roller was surface treated by dipping it in a solution containing 10% by weight of an oil-free alkyd resin and 10% by weight of a melamine resin in toluene, pulling up the roller, and heat drying.

Example 2

With 100 parts of a polyisoprene polyol having a molecular weight of 2,500 and an OH value of 47.1 was blended 3.32 parts of acetylene black. The blend was agitated for 30 minutes. Then 13.33 parts of crude MDI (NCO=31.7%) and 0.001 part of dibutyltin dilaurate were added to the blend and agitated for 3 minutes. The reaction mixture was cast into a mold at 90° C. with a metallic shaft set therein and cured at 90° C. for 12 hours, thereby obtaining a developing roller of the structure shown in FIG. 1. The developing roll on the surface was ground to a surface roughness Rz of 7 $\mu$m on JIS ten point mean roughness scale. This developing roller was surface treated as in Example 1.

Example 3

A developing roller was prepared as in Example 1 except that the toluene solution used in surface treatment contained 10% by weight of an acrylic resin instead of the oil-free alkyd resin.

Example 4

A developing roller of the structure shown in FIG. 1 was prepared by mixing 100 parts of EPDM with 25 parts of ISAF carbon, 5 parts of zinc white, 1 part of stearic acid, and 1 part of dicumyl peroxide, wrapping the mixture around a metallic shaft, and molding the mixture in a mold preheated at 150° C. under a pressure of 100 kg/cm for 30 minutes. The developing roll on the surface was ground to a surface roughness Rz of 7 $\mu$m on JIS ten point mean roughness scale.

The developing roller was surface treated by dipping it in a solution containing 10% by weight of a silicone resin and 10% by weight of a urea resin in toluene, pulling up the roller, and heat drying.

Example 5

A developing roller was prepared as in Example 1 except that in the toluene solution used in surface treatment, 50 parts of a solvent soluble fluorocarbon resin was added per 100 parts of the resin component.

Example 6

A developing roller was prepared as in Example 1 except that in the toluene solution used in surface treatment, 200 parts of microparticulate amino-modified silicone resin was added per 100 parts of the resin component.

Example 7

A developing roller was prepared as in Example 1 except that in the toluene solution used in surface treatment, 5 parts as solids of a silicone surfactant was added per 100 parts of the resin component.

Example 8

A developing roller was prepared as in Example 1 except that in the toluene solution used in surface treatment, 10 parts of a positive charged silica was added per 100 parts of the resin component.

Example 9

A developing roller was prepared as in Example 1 except that in the toluene solution used in surface treatment, 0.01 part of sodium perchlorate was added per 100 parts of the resin component.

Example 10

A developing roller was prepared as in Example 1 except that in the toluene solution used in surface treatment, 10 parts of carbon black was added per 100 parts of the resin component.

Example 11

A developing roller was prepared as in Example 3 except that 50 parts of a silicone rubber was added per 100 parts of EPDM. The developing roller was surface treated by dipping it in a solution containing 10% by weight of a urethane resin, 10% by weight of a melamine resin and 0.3% by weight of sodium perchlorate in toluene/MEK/isopropyl alcohol, pulling up the roller, and heat drying.

Comparative Example 1

A developing roller was prepared as in Example 1 except that the surface treatment was omitted.

Comparative Example 2

A developing roller was prepared as in Example 1 except that instead of the surface treatment, a coating layer of about 10 $\mu$m thick was formed on the surface of the roller using a methanol solution containing 18% by weight of soluble nylon.

Comparative Example 3

A developing roller was prepared as in Example 1 except that surface treatment was carried out using a solution containing 10% by weight of a polymethyl methacrylate in toluene/MEK.

The developing rollers obtained in Examples and Comparative Examples were examined by the following tests.

Roller resistance

With a load of 500 grams attached to each end of a developing roller, the roller was placed under pressure contact with a copper plate. The roller was measured for resistance by means of a resistance meter R8340A (ADVANTEST K.K.) by applying a voltage of 100 volts.

Surface roughness

A roller was measured for surface roughness by means of a surface roughness meter Handy-Surf Model E-30A (Tokyo Seimitsu K.K.).

Contamination to photoconductor drum

With a load of 500 grams attached to each end of a developing roller, the roller was placed under pressure contact with a photoconductor drum for use in a printer PC-PR 1000E/4 (NEC K.K.). The roller and the drum were kept in pressure contact at 55° C. and RH 85% for 5 days. The drum was visually observed for surface stain. With the drum mounted in the printer, the printer was operated to produce printed images, which were visually observed.

Toner charge quantity

A roller was mounted in the developing unit of FIG. 2 as the developing roller. While the developing roller was rotated at a circumferential speed of 50 mm/sec., a uniform thin layer of toner was formed on its surface. The toner layer was pneumatically sucked into a Faraday gage for measuring an electric charge quantity.

Image reproduction

Images were reproduced through reversal development by mounting a roller in the developing unit of FIG. 2 as the developing roller, rotating it at a circumferential speed of 60 mm/sec., and feeding a non-magnetic one-component toner having a mean particle size of 7 $\mu$m. The images at the initial and after 5,000 sheets of printing were examined for quality (sharpness and density uniformity), fog and toner debris.

The results are shown in Table 1.

TABLE 1

| | Surface treating resin | Roller resistance (Ω) $R_1$ | Roller resistance (Ω) $R_2$ | Roller resistance (Ω) log ($R_2/R_1$) | JIS-A hardness (°) | Rz ($\mu$m) | Toner charge quantity ($\mu$C/g) Initial | Toner charge quantity ($\mu$C/g) 5000 sheets | Drum contamination | Image quality |
|---|---|---|---|---|---|---|---|---|---|---|
| E1 | alkyd/melamine | $5 \times 10^3$ | $3 \times 10^5$ | 1.78 | 43 | 7 | −12.5 | −9.5 | none | good |
| E2 | alkyd/melamine | $7 \times 10^3$ | $2 \times 10^5$ | 1.46 | 42 | 7 | −12.5 | −9.5 | none | good |
| E3 | alkyd/melamine | $5 \times 10^3$ | $2 \times 10^5$ | 1.60 | 43 | 7 | −12.0 | −8.0 | none | good |
| E4 | silicone/urea | $4 \times 10^5$ | $5 \times 10^7$ | 2.10 | 45 | 6 | −10.0 | −7.5 | none | good |
| E5 | alkyd/melamine + fluororesin | $5 \times 10^3$ | $5 \times 10^5$ | 2.00 | 43 | 6 | −11.0 | −8.0 | none | good |
| E6 | alkyd/melamine + silicone particle | $5 \times 10^3$ | $8 \times 10^5$ | 2.43 | 43 | 8 | −12.0 | −9.0 | none | good |
| E7 | alkyd/melamine + silicone surfactant | $5 \times 10^3$ | $2 \times 10^5$ | 1.60 | 43 | 6 | −12.0 | −8.5 | none | good |
| E8 | alkyd/melamine + positive charge silica | $5 \times 10^3$ | $1 \times 10^6$ | 2.30 | 43 | 8 | −12.5 | −9.5 | none | good |
| E9 | alkyd/melamine | $5 \times 10^3$ | $1 \times 10^5$ | 1.30 | 43 | 7 | −13.5 | −10.0 | none | good |
| E10 | alkyd/melamine | $5 \times 10^3$ | $7 \times 10^4$ | 1.15 | 44 | 6 | −10.5 | −7.5 | none | good |
| E11 | urethane/melamine | $2 \times 10^6$ | $7 \times 10^6$ | 0.54 | 43 | 6 | −11.5 | −7.5 | none | good |
| CE1 | none | $5 \times 10^3$ | — | — | 43 | 7 | −4.5 | −3.5 | contaminated | *1 |
| CE2 | soluble nylon | $5 \times 10^3$ | $4 \times 10^8$ | 4.9 | 46 | 3 | −11.0 | −7.0 | none | *2 |
| CE3 | PMM | $5 \times 10^3$ | $7 \times 10^4$ | 1.20 | 43 | 7 | −8.5 | −4.0 | none | *3 |

*1 solid white area skipping, fog
*2 solid black area density lowering, inefficient toner conveyance
*3 density lowering from 1000 sheets, fog A series of rollers were prepared as in Example 1 while varying the resin concentration of the surface treating solution from 0% to 18% by weight. The rollers were similarly measured for resistance. The resistance was plotted as a function of a resin concentration in the graph of FIG. 3.

For the roller of Example 10, images were reproduced by rotating the roller at a linear velocity of 60 mm/sec. and 90 mm/sec. while varying the potential of the photoconductor drum. The occurrence of image fogging at a low potential (low-potential fogging) was examined. The potential at which low-potential fogging occurred remained unchanged whether the linear velocity was 60 mm/sec. or 90 mm/sec.

It is evident that the developing roller of the present invention eliminates inconvenience such as contamination of the photoconductor drum and ensures that images of quality are reproduced without a density variation and background fog and that images are not deteriorated in quality even after it is used for a long period of time.

Although some preferred embodiments have been described, many modifications and variations may be made thereto in the light of the above teachings. It is therefore to be understood that within the scope of the appended claims, the invention may be practiced otherwise than as specifically described.

We claim:

1. A developing roller comprising a highly conductive shaft and an elastic layer with conductivity formed around the shaft, said developing roller being adapted to carry a developer on its surface to form a thin layer of the developer and come in contact with or close to a latent image holder having an electrostatic latent image borne on its surface whereby the developer is supplied to the latent image holder to visualize the latent image, said elastic layer at its surface having a resin component which contains at least one of a urea resin and melamine resin, said roller satisfying the relationship: $\log(R_2/R_1) \leqq 4.5$ wherein the roller free of said resin component has a resistance $R_1$ and the roller with said resin component has a resistance $R_2$.

2. The developing roller of claim 1 wherein said resin component is free of conductive powder.

3. The developing roller of claim 1 wherein said resin component contains conductive powder.

4. The developing roller of claim 1 wherein said resin component contains at least one of a urea resin and melamine resin and at least one member selected from the group consisting of an alkyd resin, modified alkyd resin, oil-free alkyd resin, and acrylic resin.

5. The developing roller of claim 1 wherein a friction reducing agent selected from the group consisting of a silicone resin, fluorocarbon resin, fluorinated surfactant, silicone surfactant, silicone coupling agent, and silica powder is blended with said resin component in an amount of 1 to 100 parts by weight per 100 parts by weight of said resin component.

6. The developing roller of claim 1 wherein an ionic conductive substance is added to said resin component.

7. The developing roller of claim 1 wherein said elastic layer has been surface treated by dipping it in a solution containing said resin component in a concentration of up to 15% by weight.

8. The developing roller of claim 1 wherein said elastic layer is based on a urethane elastomer or EPDM.

9. The developing roller of claim 1 wherein the resin component is locally distributed on the surface of said elastic layer.

10. An apparatus for developing an electrostatic latent image comprising a latent image holder for bearing an electrostatic latent image on its surface and a developing roller for carrying a developer on its surface wherein said developing roller is brought in contact with or close to the surface of said latent image holder whereby the developer is adhered to the latent image on the surface of said latent image holder to visualize the latent image, said developing roller comprising a highly conductive shaft and an elastic layer with conductivity formed around the shaft, said elastic layer at its surface having a resin component which contains at least one of a urea resin and melamine resin, said roller satisfying the relationship:

$$\log(R_2/R_1) \leqq 4.5$$

wherein the roller free of said resin component has a resistance $R_1$ and the roller with said resin component has a resistance $R_2$.

11. The apparatus of claim 10 wherein said resin component of the developing roller is free of conductive powder.

12. The apparatus of claim 10 wherein said resin component of the developing roller contains conductive powder.

13. The apparatus of claim 10 wherein said resin component of the developing roller contains at least one member selected from the group consisting of an alkyd resin, modified alkyd resin, oil-free alkyd resin, and acrylic resin.

14. The apparatus of claim 10 wherein a friction reducing agent selected from the group consisting of a silicone resin, fluorocarbon resin, fluorinated surfactant, silicone surfactant, silicone coupling agent, and silica powder is blended with said resin component of the developing roller in an amount of 1 to 100 parts by weight per 100 parts by weight of said resin component.

15. The apparatus of claim 10 wherein an ionic conductive substance is added to said resin component of the developing roller.

16. The apparatus of claim 10 wherein said elastic layer of the developing roller has been surface treated by dipping it in a solution containing said resin component in a concentration of up to 15% by weight.

17. The apparatus of claim 10 wherein said elastic layer of the developing roller is based on a urethane elastomer or EPDM.

18. The apparatus of claim 10 wherein said resin component of the developing roller is locally distributed on the surface of said elastic layer.

* * * * *